US011359640B2

(12) United States Patent
Laufer et al.

(10) Patent No.: US 11,359,640 B2
(45) Date of Patent: Jun. 14, 2022

(54) SET OF PARTS AND METHOD FOR PRODUCING A RADIAL FAN

(71) Applicant: ebm-papst St. Georgen GmbH & Co. KG, St. Georgen (DE)

(72) Inventors: Wolfgang Laufer, Aichhalden (DE); Peter Ragg, Schönwald (DE); Arno Karwath, Deisslingen (DE); Francisco Rojo, St. Georgen (DE); Raul Rosas, Villingen-Schwenningen (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 29 days.

(21) Appl. No.: 16/794,659

(22) Filed: Feb. 19, 2020

(65) Prior Publication Data

US 2020/0182255 A1 Jun. 11, 2020

Related U.S. Application Data

(63) Continuation of application No. PCT/EP2018/073721, filed on Sep. 4, 2018.

(30) Foreign Application Priority Data

Sep. 21, 2017 (DE) ..... 10 2017 008 855.1

(51) Int. Cl.
*F04D 29/28* (2006.01)
*F04D 29/16* (2006.01)
(Continued)

(52) U.S. Cl.
CPC ..... *F04D 29/162* (2013.01); *F04D 25/166* (2013.01); *F04D 29/281* (2013.01);
(Continued)

(58) Field of Classification Search
CPC .... F04D 25/166; F04D 29/162; F04D 29/281; F04D 29/30; F04D 29/4226;
(Continued)

(56) References Cited

U.S. PATENT DOCUMENTS 4,902,199 A 2/1990 McDonald et al.
5,258,676 A * 11/1993 Reinhardt ..... F04D 25/0613 310/112
(Continued)

FOREIGN PATENT DOCUMENTS

CN 104251229 A 12/2014
DE 20309621 U1 9/2003
(Continued)

OTHER PUBLICATIONS

German Search Report (in German) dated Aug. 16, 2018 in corresponding German Application No. 102017008855.1.
(Continued)

*Primary Examiner* — Ninh H. Nguyen
(74) *Attorney, Agent, or Firm* — Harness, Dickey & Pierce, P.L.C.

(57) ABSTRACT

A set of parts for a radial fan has a fan wheel (2), a main housing part (1), and a complementary housing part (3). They can be assembled to form a first housing that encloses the fan wheel (2). The housing has an inlet opening (27) and an outlet (23). At least one second complementary fan wheels (2', 2") (3', 3"), the shape of which differs from the first fan wheel part (2), can be connected to the motor instead of the fan wheel (2).

15 Claims, 2 Drawing Sheets

(51) Int. Cl.

| | |
|---|---|
| ***F04D 29/30*** | (2006.01) |
| ***F04D 29/42*** | (2006.01) |
| ***F04D 29/58*** | (2006.01) |
| ***F04D 29/62*** | (2006.01) |
| ***F04D 25/16*** | (2006.01) |

(52) U.S. Cl.
CPC ..... *F04D 29/30* (2013.01); *F04D 29/4226* (2013.01); *F04D 29/582* (2013.01); *F04D 29/624* (2013.01); *F05D 2230/60* (2013.01); *F05D 2240/55* (2013.01)

(58) Field of Classification Search
CPC .. F04D 29/582; F04D 29/624; F05D 2230/60; F05D 2240/55
See application file for complete search history.

(56) References Cited

U.S. PATENT DOCUMENTS

| | | | | |
|---|---|---|---|---|
| 5,893,705 | A * | 4/1999 | Khan | F04D 17/105 417/354 |
| 6,050,772 | A * | 4/2000 | Hatakeyama | F04D 29/283 29/888.024 |
| 6,589,013 | B2 | 7/2003 | Abdallah | |
| 7,476,076 | B2 * | 1/2009 | Shimada | F04D 29/162 415/119 |
| 7,828,510 | B2 * | 11/2010 | Chang | F04D 29/582 415/61 |
| 8,684,661 | B2 * | 4/2014 | Horng | F04D 17/04 415/53.1 |
| 2007/0059167 | A1 | 3/2007 | Hancock | |
| 2007/0247009 | A1 | 10/2007 | Hoffman et al. | |

FOREIGN PATENT DOCUMENTS

| | | | |
|---|---|---|---|
| DE | 102004022962 | A1 | 6/2005 |
| DE | 102016001484 | A1 | 8/2017 |

OTHER PUBLICATIONS

International Search Report and Written Opinion (in German) dated Nov. 23, 2018 in corresponding PCT Application No. PCT/EP2018/073721.

* cited by examiner

SET OF PARTS AND METHOD FOR PRODUCING A RADIAL FAN

CROSS-REFERENCE TO RELATED APPLICATIONS

This application is a continuation of International Application No. PCT/EP2018/073721, filed Sep. 4, 2018, which claims priority to German Application No. 10 2017 008 855.1, filed Sep. 21, 2017. The disclosures of the above applications are incorporating herein by reference.

FIELD

The present disclosure relates to a set of parts for producing a radial fan and its use.

BACKGROUND

A radial fan typically has a housing with a chamber where a fan wheel rotates about an axis, an inlet opening adjacent to the axis, and an outlet opening located at the periphery of the chamber.

The relationship between the speed of the fan wheel, the pressure difference between inlet and outlet openings, and volumetric flow depends on the geometry of the fan wheel and the chamber receiving it. This is a characteristic of each fan model. The requirements of this relationship must meet and vary based on the intended application of the radial fan. If a fan is, for example, used for cooling purposes, its volumetric flow should vary as little as possible with a varying pressure difference. This maintains a sufficient cooling air flow even under the most unfavorable conditions, e.g. when the cross section of the cooling air path is restricted. If, on the other hand, a fan is used to ventilate a patient, a strong dependence of the volumetric flow on the pressure difference is desired. This provides a high volumetric flow when the patient inhales. However, it does not obstruct the patient's exhaling by too high a counterpressure.

Conventionally, these opposing requirements are satisfied in that different fans are designed for cooling or for ventilating. Only small numbers of the respective specific housing parts for these fans are needed. Thus, this results in accordingly high unit costs.

SUMMARY

It is the object of the present disclosure to create a set of parts and a method where fans can be provided at low cost and with a relationship of pressure difference and volumetric flow adjusted to a respective application.

The object is achieved by a set of parts for a radial fan that includes, in addition to a first fan wheel, a main housing part, and a complementary housing part. The parts can be assembled to form a housing enclosing the fan wheel with an inlet opening and an outlet opening. A second fan wheel, that differs in shape from the first fan wheel, can be rotatably mounted about an axis in the wheel chamber instead of the first fan wheel.

The fan wheel is, in a suitable manner, specifically optimized with respect to a desired relationship between pressure and volumetric flow. Accordingly, multiple versions are needed to represent different relationships. Thus, application specific modification of the housing parts can be eliminated. Cost advantages result from the fact that the non-application specific parts can be provided in large volumes at low cost. Also, the application specific fan wheels are necessarily smaller than the housing parts that define the wheel chamber that receives them. Thus, they can be produced using small, relatively simple, and accordingly inexpensive tools.

The advantage of simple production becomes particularly evident when the fan wheels each have a base plate and vane blades. The fan blades project in the axial direction from the base plate. The fan blades have free edges facing away from the base plate. These parts can typically be formed using just two tool parts that can be moved against one another in the axial direction. Production of the housing parts requires tools that can also be moved in the radial direction, particularly if these comprise interacting latches.

If the inlet opening is provided in the complementary housing part and a fan wheel is mounted in the wheel chamber, its base plate should face the main housing part. Its vane blades should face the complementary housing part.

The outlet should roughly be located in the plane of the fan wheel. it is expediently defined by the main housing part and by the complementary housing part.

To ensure exchangeability of the fan wheels, they should all have identical interfaces to fasten to a shaft of the motor. These interfaces may for example be passages with an identical non-circular cross section. The shaft can be inserted in a torque-transmitting manner into the interfaces. Alternatively, flanges could be spaced apart from one another along the axis on both sides of a passage. This enables clamping of the fan wheel between a shoulder of the shaft and a screwed-on nut, for example.

There is an inevitable gap extending between the free edges of the vane blades of a fan wheel mounted in the wheel chamber and a wall of the complementary housing part defining the wheel chamber. Air flows through the gap back to the inlet if there is a sufficient pressure difference between inlet opening and outlet. This impairs the throughput of the fan. To improve the efficiency of the fan, the complementary housing part may include a structure concentrically extending about the axis on the wall defining the wheel chamber. The fan wheels may be provided with contours on their free edges of their vane blades. The contours form a labyrinth seal with the concentric structure. The concentric structure may, for example, be a circumferential groove that is opposed by projections on the edges of the vane blades. Alternatively, the concentric structure may include a projection extending about the axis that is opposed by recesses of the free edges.

To obtain different pressure-volumetric flow curves for each of the fan wheels, the first and the second fan wheels should differ in the number and/or length of vane blades. Other features, such as the design of the base plate, the axial extension of the vane blades, their wall thickness, or extension of their free edges can remain the same from one fan wheel to the other within the limits set by production accuracy.

The effort required for designing and producing molding tools for the various fan wheels can be limited. Thus, the shape of the second fan wheel is derived from that of the first fan wheel by adding at least one vane blade. The first fan wheel would fit in the die used to produce the second and would fill this die but for the added vane blade.

The radius of an end near the axis of the added vane blade should be greater than that of an end near the axis of at least one vane blade of the first fan wheel. Thus, additional vane blades do not restrict the free cross section, and thus the volumetric flow, of the fan too much.

The vane blades of each fan wheel inevitably have an inner edge oriented transversely to the direction of the air flow, past which edge, the blowing air enters a duct between two air blades. This spacing can be different for the vane blades of an individual fan wheel, as can be deducted from the preceding paragraph. To obtain different shapes of the pressure-volumetric flow curve, such as in one case to obtain a limited dependence of volumetric flow on the pressure and in another case a strong dependence, it is useful that the set of parts includes two fan wheels. The fan wheels differ in the spacing from the axis of their respective inner edges located closest to the axis.

To obtain a high increase in pressure between inlet opening and outlet, the inner edge closest to the axis of at least one fan wheel should at least partially be within a cylinder. The cylinder is concentric with the axis. The diameter matches the diameter of the inlet opening.

Vice versa, it is useful for high variability of the volumetric flow at little pressure variation if the inner edge closest to the axis is outside this cylinder for at least one fan wheel. The fan wheel is preferably mounted to the main housing part, opposite the inlet opening of the complementary housing part. Expediently, installation space is provided on the main housing part for a motor driving the fan wheel.

The object is further achieved by a method for producing a radial fan comprising the steps of:

providing a set of parts as described above;

selecting one of the fan wheels of the set of parts; and assembling the selected fan wheel, the main housing part, and the complementary housing part.

Other advantageous further developments of the disclosure are characterized in the dependent claims or are explained in more detail below with reference to the figures and together with a preferred embodiment of the disclosure.

DRAWINGS

Further features and advantages of the disclosure result from the subsequent description of exemplary embodiments with reference to the enclosed figures.

DETAILED DESCRIPTION

Figure 1:
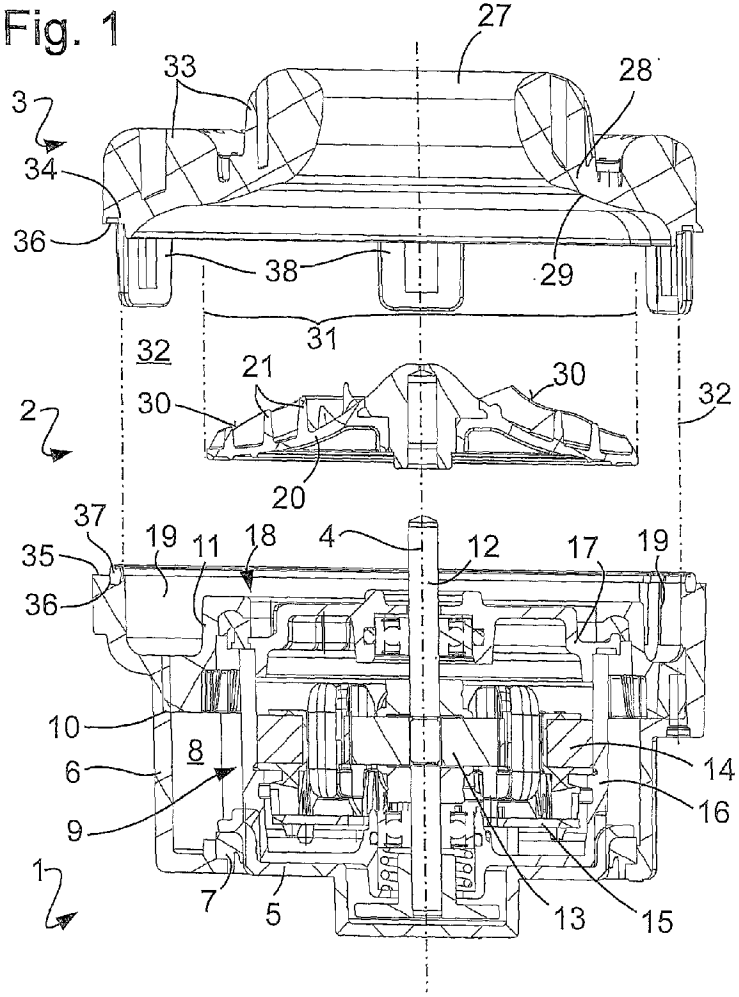
FIG. 1 is an expanded sectional view in an axial direction of a set of parts.

FIG. 1 is an expanded view of a main housing part 1, a fan wheel 2, and a complementary housing part 3 of a radial fan. The section plane of FIG. 1 extends along a rotational axis 4 of the fan wheel 2.

The main housing part 1 includes a bottom plate 5, an outer wall 6, and an elastic buffer ring 7. The bottom plate 5 is joined with the outer wall 6 by the buffer ring 7 to form an outer cup. An electric motor 9 is concentrically housed in the outer cup. This forms an annular peripheral cooling duct 8. It is enclosed by a partition wall 11 that is supported on a shoulder 10 of the outer wall 6.

The electric motor 9 includes a shaft 12, a rotor 13, a stator 14, and a circuit board 15. The circuit board 15 carries an inverter to supply the stator 14 with power, and the components 12-15 mentioned above. The housing includes an inner cup 16 and a lid 17. The lid 17 closes the inner cup 16. The shaft 12 projects through the central opening of the lid 17.

The partition wall 11 and the lid 17, exposed in the opening of the partition wall, form a central tray 18 around the rotational axis 4. A rim section of the partition wall 11, surrounding the central tray 18, leaps back into the interior of the outer cup. Together, with the outer wall 6, they define a groove 19 that extends about the rotational axis 4. They groove 19 cross section gradually increases along the periphery of the cup.

The fan wheel 2 has a base plate 20 that extends transversely to the rotational axis 4. The base plate diameter is not greater than that of the tray 18. One side of the base plate 20 is located opposite the tray 18 and in close proximity thereto in the assembled state. An axial passage 47 of the fan wheel 2 is provided to receive the end of the shaft 12. In the case shown here, the passage 47 is injection-molded to the base plate 20 and the vane blades 21 of the fan wheel 2. It is a sleeve made of metal, particularly of brass. The inner diameter is adjusted to the diameter of the shaft 12. Thus, the fan wheel 2 can be mounted by pressing it onto the shaft 12.

Vane blades 21 project in the axial direction from the base plate 20 on a side facing away from the tray 18. This side can have the shape of a cone or a hyperboloid of revolution.

Figure 2:
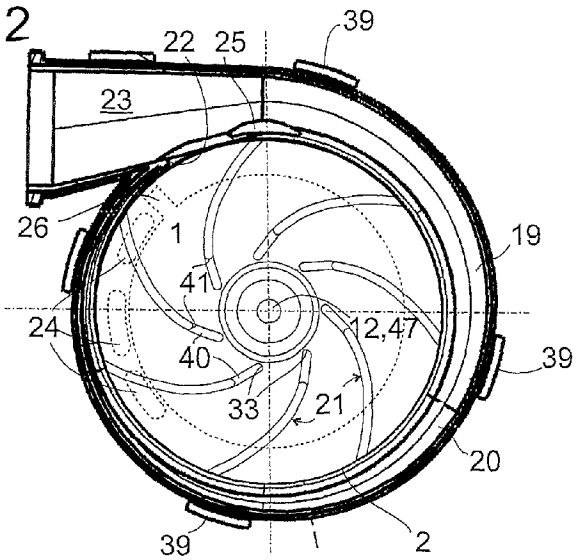
FIG. 2 is a top view in the axial direction of a main housing part and a fan wheel of the set of parts.

FIG. 2 shows a top view of the main housing part 1 and the fan wheel 2 mounted onto the shaft 12. Clearly visible is the groove 19 that extends from a starting point 22. The groove 19 gradually widening counterclockwise around the fan wheel 2. The groove 19 transitions into an outlet 23 branching off tangentially to the periphery of the fan wheel 2. The vane blades 21 have the form of ribs. They extend helically from an inner end 33, facing the rotational axis 4, to the rim of the base plate 20.

The partition wall 11 has one or more openings 24. The openings 24 enable the groove 19 to communicate with the cooling air duct 8 near the starting point 22. These openings 24 are hidden by the fan wheel 2 in FIG. 2 and are shown by dashed lines. Another passage 25, between the groove 19 and the cooling air duct 8, is located at the outlet 23.

The rotation of the fan wheel 2 generates a higher pressure in from the passage 25 than at the openings 24. Thus, air enters the cooling air duct 8 via the passage 25 and absorbs exhaust heat from the motor 9. The cooling air exits from the cooling air duct 8 via the openings 24. A radial wall 26 between the motor 9 and the outer wall 6 partitions the cooling air duct 8 and forces the sucked in air to almost completely circle the motor 9 on its way from the passage 25 to the openings 24.

The complementary housing part 3 has an end wall 28. The end wall 28 extends about the rotational axis 4 around an inlet opening 27. The funnel-shaped inner surface 29 opposes, at a close distance in the assembled state, the free edges 30 of the air blades 21 that face away from the base plate 20. The funnel-shaped inner surface 29 extends radially beyond the rim of the base plate 20. It hits an inner surface of the outer wall 6. In the final assembled fan, the end wall 28 defines a wheel chamber 31 where the fan wheel 2 rotates. The end wall 28, together with the groove 19, defines a blowing air duct 32 that extends around the wheel chamber 31. The rotation of the fan wheel 2 generates a positive pressure in the chamber 31.

Figure 3:
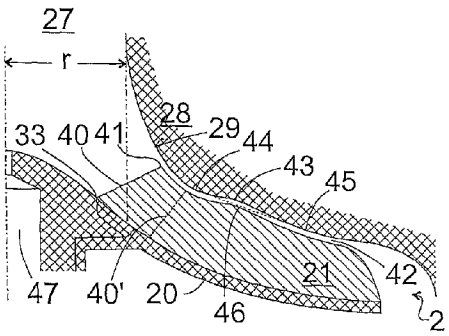
FIG. 3 is an enlarged detail radial section view of the finished fan.

The extension of the free edges 30 of the vane blades 21 is difficult to see due to the spiral shape of the vane blades 21 in a radial section through the fan wheel 2, as shown in FIG. 1. FIG. 3 is an enlarged sectional view along the rotational axis 4. Shown is a radius through the complementary housing part 3 and a rotational body obtained by the rotation of the fan wheel 2 about the rotational axis 4. It is clearly visible that the edges 30, starting from the inner end 33 and first extending along an inner edge 40, steeply converge towards the end wall 28 and then, beyond a crest 41. This defines a gap 42 of a substantially constant width over a large part of their length together with the inner surface 29 of the end wall 28.

The inner surface 29 is divided by a flat groove 43 into an inner and an outer section 44, 45, both are convexly curved. Projections 46 on the edges 30 of the vane blades 21 are located opposite the groove 43. If a high pressure difference between the outlet 23 and the inlet opening 27 drives a return flow of air along the gap 42 to the inlet opening 27, the flow tends to bridge the groove 43 in a tangential direction to the two sections 44, 45 (outlined in FIG. 3 by a thin dashed line). Thus, it is subjected to the influence of the vane blades 21. In this manner, a high pressure difference can be maintained between the outlet 23 and the inlet opening 27 at a given speed of the fan wheel 2.

Referring again to FIG. 1, an annular flange 34 extends perpendicular to the rotational axis 4 around the inner surface 29. It is opposed by a flange 35 on an upper edge of the outer wall 6. Each of the two flanges 34, 35 includes an annular groove 36. A sealing ring 37, in the assembled state, engages in both annular grooves 36 radially sealing the blowing air duct 32 from the outside.

Brackets 38 project beyond the flange 34. The brackets 38 are distributed across the periphery of the complementary housing part 3. The brackets 38 are provided to be latched onto projections 39 (see FIG. 2) on the outer wall 6 of the main housing part 1 during assembly of the housing. Thus, this permanently joins the housing parts 1, 3.

It would also be conceivable to replace one or two brackets 38 and projections 39 by a film hinge. Thus, the two housing parts could be folded onto one another after mounting the fan wheel 2.

Figure 4:
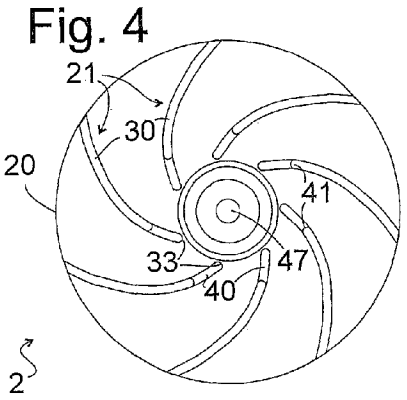
FIGS. 4-7 are top plan views of various fan wheels of the set of parts.
Figure 5:
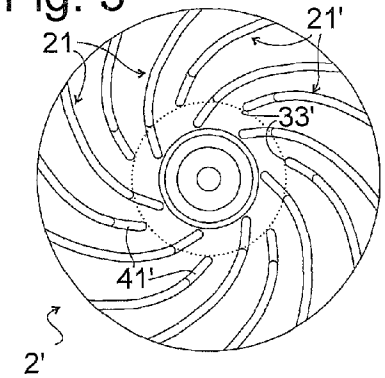
Figure 6:
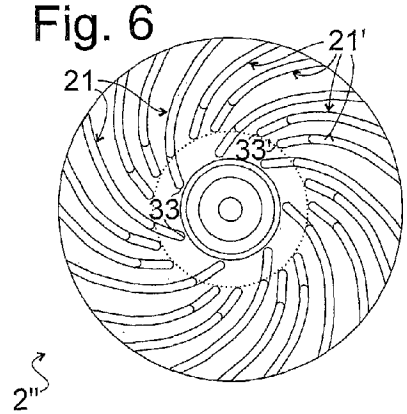
Figure 7:
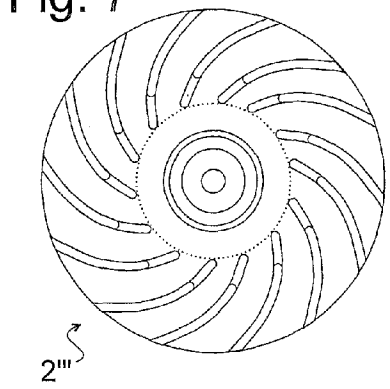

FIG. 4 shows the fan wheel 2 of FIGS. 1 and 2 by itself to clarify how the fan wheel 2 differs from other fan wheels 2, 2", 2'" of the set of parts according to the disclosure, shown in FIGS. 5-7. The figures show the features these wheels have in common.

The diameter of the base plate 20 and the shape of the passage 47, receiving the shaft 12, preferably also the curvature of the side of the base plate 20, that carries the vane blades 21, are identical in all fan wheels. The vane blades 21 of the fan wheel 2 are present in identical number, with identical wall thickness and extension of the edge 30 in the fan wheels 2', 2" of FIGS. 5 and 6. One vane blade is added in each intermediate space between vane blades 21 in the fan wheel 2' of FIG. 5. Two additional vane blades 21' are added in the fan wheel 2" of FIG. 6. The additional vane blades 21' double or triple the frequency with which an outer end of a vane blade passes the starting point 22 compared to the fan wheel 2. This causes turbulences at the starting point 22. Also, the additional vane blades 21' block the space turbulence needs to spread and greatly dampen them in this manner. This results, on the one hand, in dampening the flow noise of the fan wheel. On the other hand, in a frequency increase that, at a suitable speed of the fan, moves a portion of the operating noise spectrum out of the audible range. Both features contribute to reducing the operating noise of the fan wheels 2', 2" compared to the fan wheel 2.

The additional vane blades 21' narrow the flow area of the wheel chamber 31. Thus, this results in higher flow losses and lower efficiency. A user will therefore select the fan wheel 2 for commercial applications in environments that are noisy anyway and where low operating costs are an important factor. The fan wheels 2', 2" are preferred for applications in non-commercial areas where a loud operating noise will be clearly perceived.

To limit the loss in efficiency, the inner ends 33' of the additional vane blades 21' are disposed at a greater distance from the axis 4 than the inner ends 33 of the vane blades 21. The inner edges 40 of the vane blades 21 largely extend within the radius r of the inlet opening 27. Respective edges 40' of the additional vane blades 21' are located outside that radius.

The fan wheel 2" of FIG. 7 strongly resembles the fan wheel 2' from FIG. 5. The number of vane blades is the same in both. The difference between the two is that the inner ends 33 of all vane blades 21' are outside the radius r of the inlet opening 27 in the fan wheel 2'".

Figure 8:
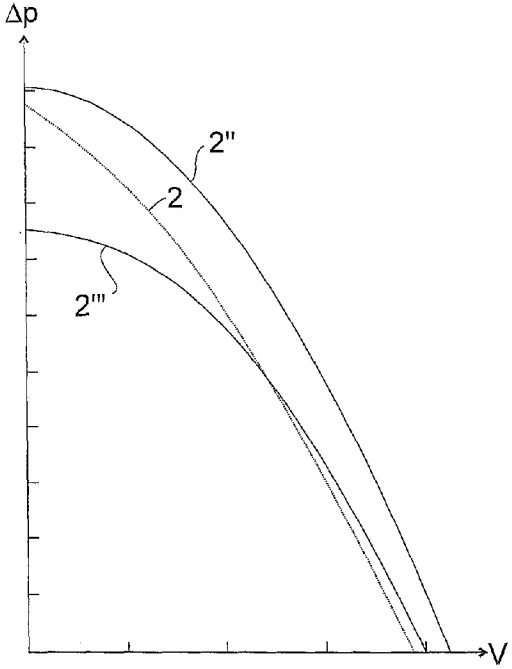
FIG. 8 is a graph of pressure-volumetric flow curves of various fan wheels.

FIG. 8 illustrates the influence of these design differences based on pressure-volumetric flow curves of the fan wheels 2, 2", and 2'". The curves are shown in arbitrary units, since the values differ in each individual case depending on the dimensions of the fan wheels and their speeds. They were recorded, however, for the fan wheels with the same dimensions at the same speed and can thus be compared. The strongest dependence of the volumetric flow V on the pressure difference $\Delta p$ is found in fan wheel 2. This is therefore well suited to infer the volumetric flow from a pressure increase that can be measured easily and reliably and generates a predetermined volumetric flow by controlling the speed depending on pressure. The fan wheel 2" reaches the comparatively highest values of volumetric flow and pressure. It is, therefore, suitable for building a fan with a high power density. The fan wheel 2'" shows low dependency on the volumetric flow. Primarily in the low volumetric flow range. Thus, a fan with this fan wheel can limit pressure variations in an application with varying volumetric flow, e.g. in a breathing apparatus. It can prevent severe pressure increases when the volumetric flow is interrupted in an exhaling phase of the patient to allow subsequent calm inhalation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A set of parts for a radial fan comprising:

a first fan wheel, a main housing part, and a complementary housing part that are assembled to form a wheel chamber surrounding the first fan wheel and an inlet opening and an outlet;

at least one second fan wheel substituted for the first fan wheel, the shape of which differs from that of the first fan wheel and the at least one second fan wheel can be rotatably mounted in the wheel chamber at a place where the removed first fan wheel was positioned about an axis into the wheel chamber instead of the first fan wheel;

a shape of the second fan wheel is derived from that of the first fan wheel by adding at least one vane blade and a radius of an end near the axis of the added vane blade is greater than that of an end near the axis of at least one vane blade of the first fan wheel;

the complementary housing part further comprises a structure concentrically extending about the axis on a wall defining the wheel chamber, and the fan wheels have contours on their free edges of their vane blades, the contours form a labyrinth seal with the concentric structure.

2. The set of parts according to claim 1, wherein the fan wheels have a base plate and vane blades, projecting in the axial direction from the base plate, with free edges of the vane blades facing away from the base plate.

3. The set of parts according to claim 1, wherein the inlet opening is provided in the complementary housing part and in the mounted state of one of the fan wheels its base plate faces the main housing part and its vane blades face the complementary housing part.

4. The set of parts according to claim 1, wherein the outlet is defined by the main housing part and the complementary housing part.

5. The set of parts according to claim 1, wherein the fan wheels have identical interfaces for fastening to a shaft of a motor.

6. The set of parts according to claim 1, wherein the first and the second fan wheels differ in the number and/or length of the vane blades.

7. The set of parts according to claim 1, wherein the vane blades of each fan wheel have an inner edge oriented transversely to the direction of the air flow, and the set of parts includes two fan wheels, that differ by the distance of their respective inner edge closest to the axis from the axis.

8. The set of parts according to claim 7, wherein the inner edge closest to the axis is in at least one fan wheel is at least partially inside a cylinder concentric with the axis, the diameter of which cylinder matches a diameter of the inlet opening.

9. The set of parts according to claim 7, wherein the inner edge closest to the axis is in at least one fan wheel outside a cylinder concentric with the axis, the diameter of the cylinder matching the diameter of the inlet opening.

10. The set of parts according to claim 1, wherein the fan wheels are is mounted in the main housing part.

11. The set of parts according to claim 1, wherein an installation space for a motor is provided in the main housing part.

12. A method for producing a radial fan, comprising the steps of:

providing a set of parts according to claim 1;

selecting one of the fan wheels of the set of parts; and assembling the selected fan wheel, the main housing part, and the complementary housing part.

13. A set of parts for a radial fan comprising:

a first fan wheel, a main housing part, and a complementary housing part that are assembled to form a wheel chamber surrounding the first fan wheel and an inlet opening and an outlet;

at least one second fan wheel substituted for the first fan wheel, the shape of which differs from that of the first fan wheel and the at least one second fan wheel can be rotatably mounted in the wheel chamber at a place where the removed first fan wheel was positioned about an axis into the wheel chamber instead of the first fan wheel;

the complementary housing part further comprises a structure concentrically extending about the axis on a wall defining the wheel chamber, and the fan wheels have contours on their free edges of their vane blades, the contours form a labyrinth seal with the concentric structure; and the vane blades of each fan wheel have an inner edge oriented transversely to the direction of the air flow, and the fan wheels differ by the distance of their respective inner edge closest to the axis from the axis.

14. The set of parts according to claim 13, wherein the inner edge closest to the axis is in at least one fan wheel is at least partially inside a cylinder concentric with the axis, the diameter of which cylinder matches a diameter of the inlet opening.

15. The set of parts according to claim 13, wherein the inner edge closest to the axis is in at least one fan wheel outside a cylinder concentric with the axis, the diameter of the cylinder matching the diameter of the inlet opening.

* * * * *